US005937588A

United States Patent [19]

Gard

[11] Patent Number: 5,937,588

[45] Date of Patent: Aug. 17, 1999

[54] BALE WITH INTEGRAL LOAD-BEARING STRUCTURAL SUPPORTS

[76] Inventor: Marvin Gard, Rte 4 Box 30G, Hernandez, N.Mex. 87537

[21] Appl. No.: 08/739,886

[22] Filed: Oct. 30, 1996

Related U.S. Application Data

[60] Provisional application No. 60/008,033, Oct. 30, 1995.

[51] Int. Cl.[6] ..... E04H 5/08

[52] U.S. Cl. ..... 52/79.1; 52/DIG. 9; 52/79.4; 52/223.7

[58] Field of Search ..... 52/DIG. 9, 79.1, 52/79.4, 223.7

[56] References Cited

U.S. PATENT DOCUMENTS

| | | | |
|---|---|---|---|
| 169,518 | 11/1875 | Brown | 206/83.5 |
| 181,389 | 8/1876 | Archer | 206/83.5 |
| 185,106 | 12/1876 | Ingersoll . | |
| 312,375 | 2/1885 | Orr . | |
| 729,408 | 5/1903 | Pickin | 52/DIG. 9 |
| 801,361 | 10/1905 | Clayton et al. | 52/DIG. 9 |
| 1,604,097 | 10/1926 | Hewlett | 52/432 |
| 1,745,588 | 2/1930 | Shodron | 52/DIG. 9 X |
| 4,154,030 | 5/1979 | Huguet | 52/98 |
| 5,398,472 | 3/1995 | Eichlkraut | 52/DIG. 9 X |
| 5,749,199 | 5/1998 | Allen | 52/DIG. 9 X |

FOREIGN PATENT DOCUMENTS 1525387 4/1967 France .

OTHER PUBLICATIONS

Steen, Steen & Bainbridge *The Straw Bale House*.

*Primary Examiner*—Carl D. Friedman
*Assistant Examiner*—Phi Dieu Tran A

[57] ABSTRACT

The invention is a custom bale (10) comprising compressed fibrous material, integral load-bearing structural supports (20), and multiple cinctures (22) for use in construction. One embodiment utilizes an inverted-lip U-channel connector (28) as a bond beam that snaps onto the upper ends of the integral load-bearing structural supports (20) to connect the bales (10) to the roof. U channel splices (36) and (38) connect the inverted-lip U channels (28) together to form a complete bond beam around the house. The inverted-lip U channel (28) is also used as the window sill frame (41), window header (43), and footing beam. Bales with properly sized and oriented integral load-bearing structural supports (20) can also be used as posts and beams.

2 Claims, 7 Drawing Sheets

70
13
20
11
18
28
16
59
10
14
59
28

70
13
10
28
18
20
11
28
16
60
14
58

70
56
10
13
18
34
56
20
11
51
16
14
51
44

70
10
13
55
18
54
34
52
20
11
51
16
55
14
53
51
44

BALE WITH INTEGRAL LOAD-BEARING STRUCTURAL SUPPORTS

CROSS-REFERENCE TO RELATED APPLICATIONS

This application claims the benefit of the filing of U.S. Provisional Patent Application Ser. No. 60/008,033, entitled Waste Material Building Modules, filed on Oct. 30, 1995, and the specification thereof is incorporated herein by reference.

BACKGROUND—FIELD OF INVENTION

This invention is intended for use in the field of building construction, specifically, straw bale construction. It is an improved bale for construction having integral load-bearing structural supports.

BACKGROUND—BRIEF DESCRIPTION OF THE PRIOR ART

Straw bale construction is environmentally, economically, and esthetically superior to other contemporary construction techniques. Straw, which in many areas is an agricultural waste product, is ideal for use as a building material because it has low embodied energy and yet gives the wall of the structure a high thermal energy efficiency because of its excellent insulating qualities. The techniques of straw bale construction in current use, however, are antiquated; they consist basically of two techniques that date back more than 100 years. The first technique uses the bales to bear the loads of the roof, snow, and wind. Because of the variations in stress as snow loads and winds change, the interior and exterior plaster and stucco finishes are prone to cracking. Orr (U.S. Pat. No. 312,375) discloses a variation of this system in which threaded rods are used to compress the bales and maintain them in a compressed state, which alleviates the problem with plaster cracking. However, this method is not approved by building codes in many areas, because the threaded rods are not load-bearing structural supports, but simply tension members passing though or beside multiple courses of bales. Its major drawback is that it is highly labor-intensive: each individual bale must be stacked, plumbed, and pinned in place; and the multiple layers of the small bales, usually five to seven courses, must be stacked like bricks in an overlapping, break-joint fashion, which means that every other bale must be retied and then cut to size wherever there is a corner, a door, a post, a window, etc. The many joints and layers produced by this process result in numerous gaps, so that up to three times as much plaster and stucco (and, hence, labor) is needed to produce a smooth, flat wall finish as in conventional frame construction. In addition, the joints and gaps reduce the energy efficiency and the fire resistance of the house. The additional compression imposed by this system also reduces the insulating value of the vertically precompressed straw bales.

The second technique uses posts that extend from the footing to the roof and are connected at the top by beams to support the roof. Straw bales are then stacked between the posts to provide insulation and a surface for finishing. This technique, like the first, is labor-consuming: each course of bales must be anchored to the post structure, and the top course must be anchored to the beam at least every 24 inches. In addition, this technique requires large-dimension lumber or steel for the post-and-beam frame. The high cost of large-dimension lumber and steel has in many cases led builders to install windows in the walls without using support posts on the sides of the windows. Instead, they merely pin the rough bucks for the windows to the adjacent bales with wooden dowels. This produces a poorly supported window that is prone to cause cracks in the plaster and stucco surrounding it.

Both of the current straw bale construction techniques require, further, that the electrical wiring and communication cables be pushed between the bales to the proper depth to meet code requirements. This is labor-intensive and difficult, particularly with very dense bales. Specialized systems, such as central vacuum cleaners, are practically impossible to install in conventional straw bale walls because of the diameter of the piping.

Other prior art includes Hewlett (U.S. Pat. No. 1,604,097), who discloses a system that employs plaster and fiber blocks through which concrete pillars are poured for structural support. This system is also labor-intensive: the many courses of blocks must be laid by hand and then the concrete pillars must be poured. Hewlett acknowledges that this system is very difficult to use on dry, compressed fibrous material such as straw bales, because the concrete dries prematurely.

Chauvin et al. (France Pat. No. 1.525.387) disclose a bale of slaked-lime-coated straw with an outer shell that is a mixture of Portland cement and straw. These bales are not complete wall segments, do not have integral structural supports, and would have the same problem as the Hewlett system with premature drying and lack of hydration of the cement.

In another area of search, Brown (U.S. Pat. No. 169,518), Archer (U.S. Pat. No. 181,389), Ackerman (U.S. Pat. No. 183,617), and Ingersoll (U.S. Pat. No. 185,106) all disclose bales of short-cut hay or manure held together with boards or sticks. In these cases, the bales are not intended for use in construction, the boards or sticks are merely packaging for the material being baled.

Finally, Huguet (U.S. Pat. No. 4,154,030) discloses another system that uses posts and beams as the load-bearing members of a rigid building form. Non-load-bearing panels, prefabricated of recycled waste materials, span the openings of the form. Problems with this system include the potential for toxicity, from the waste materials that are molded to form the panels and/or the polymers or other carrier that bind them together, and the increased embodied energy of construction. In addition, although this system uses U channels as a tie beam, screws or bolts are still needed to hold the elements together.

OBJECTS AND ADVANTAGES

Accordingly, several objects and advantages of my invention are that it:

(a) enables very rapid construction of walls; in most cases, the walls and roof of a house can be erected in one day, owing to both the large size of the bales and the snap-together footing connection.

(b) reduces both on-site and off-site framing labor.

(c) reduces labor required for placement of electrical wiring, junction boxes, communication cables, and central vacuum cleaner piping, because precut or formed grooves are provided for these.

(d) reduces labor for installing windows and doors because support framing for these are adjacent to all openings as an integral part of the bales.

(e) reduces labor needed to achieve smooth stucco and plaster finishes by reducing the number of joints and gaps in the walls.

(f) reduces costs, both economic and environmental, by using renewable agricultural waste products as the major building material without using chemical or heat treatments (which increase embodied energy and, thus, cost), to bind the fibers together.

(g) reduces costs, both economic and environmental, by using much less steel and/or large-dimension lumber. The bale ties, compressed straw, and integral load-bearing structural supports create a synergistic package; since the compressed straw and bale ties serve as bracing for the integral load-bearing structural supports, the thickness of the supports can be reduced.

(h) reduces costs by using less stucco and plaster than conventional straw bale construction because there are fewer gaps and joints to fill.

(i) improves the already superior fire resistance of plastered straw bale construction by reducing the number of joints and gaps in the walls.

(j) increases thermal efficiency by reducing the number of joints and gaps in the walls.

(k) offers excellent protection against stresses, such as strong winds and earthquakes, because the roof-to-footing tie is much stronger than nailing.

(l) provides a means of fabricating large beams or posts using less steel or wood.

(m) provides a way to use a variety of structural materials in combinations that best exploit the unique physical properties of each.

Further objects and advantages will become apparent from the summary and the description of the figures that follow.

FIGURES

REFERENCE NUMERALS IN DRAWINGS

| | |
|---|---|
| 10 bale having integral load-bearing structural supports | |
| 11 end surface | |
| 12 end surface | 13 side surface |
| 14 side surface | 16 upper surface |
| 18 lower surface | 20 structural support |
| 22 cincture | 24 groove |
| 26 bale tie in bottom of groove | 28 inverted-lip U channel |
| 30 slot | 34 footing |
| 36 U-channel splice | 38 U-channel corner splice |
| 40 banding | 41 window sill frame |
| 42 window opening | 43 window header |
| 44 concrete fastener | 46 inverted-lip U-channel web |
| 48 inverted-lip U-channel side | 50 inverted lip |
| 51 anchor-shaped structural connector | |
| 52 anchor-shaped structural connector web | |
| 53 anchor-shaped structural connector forty-five-degree leg | |
| 54 anchor-shaped structural connector ninety-degree leg | |
| 55 arrow-shaped cutout | 56 serrated slot |
| 58 staples | 59 wire cinctures |
| 60 metal collar with serrations | 62 angle-iron structural support |
| 65 angle-iron bond beam | |
| 66 floor attachment tab | 68 attachment tab |
| 70 compressed fibrous material | 72 truss |
| 74 truss lower flange | 76 truss upper flange |
| 78 truss web | 80 parapet |
| 82 expanded metal | 84 nailer |

SUMMARY OF THE INVENTION

The invention is a bale, the main portion of which is compressed fibrous material held in compression by a plurality of cincture means. Each bale includes a pair of opposed end surfaces, a pair of opposed side surfaces, and a pair of opposed upper and lower surfaces transverse of the side and end surfaces. The compressed fibrous material and cinctures provide bracing for the integral load-bearing structural supports, creating a synergy that saves lumber or steel by allowing the use of thinner material for the integral load-bearing structural supports. The integral load-bearing structural supports, structural connectors, and secondary cinctures allow the fabrication of taller, thinner, longer bales, which facilitate more efficient straw construction.

DESCRIPTION—FIGS. 1 TO 18

Figure 1:
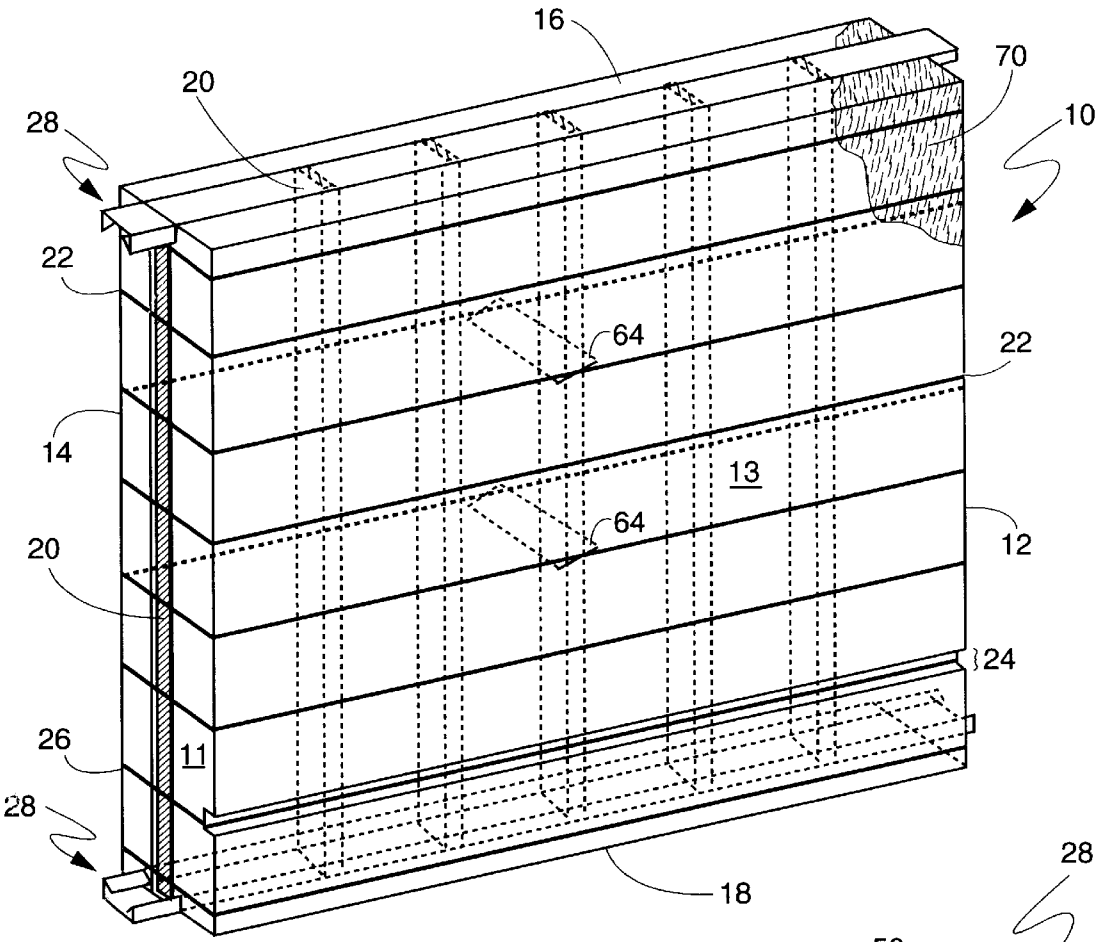
FIG. 1 shows a perspective view of the currently preferred embodiment, for walls, of a bale having integral load-bearing structural supports.

FIG. 1 shows a bale 10 having substantially parallel opposed end surfaces 11 and 12, substantially parallel opposed side surfaces 13 and 14, and substantially parallel opposed upper and lower surfaces 16 and 18. The bale 10 is composed of a main portion of compressed fibrous material 70, such as wheat straw, held together by cinctures 22 of baling twine, baling wire, or other banding material. Grooves 24 of the appropriate size and depth for electrical wiring, communication cabling, heating ducts, or central vacuum cleaner piping are cut or formed in the side faces of the bale at the desired heights (a dovetail shape will help hold the wiring, cabling, or vacuum piping in place before the surface is plastered or stuccoed). Integral load-bearing structural supports 20 extend along the end surfaces 11 and 12, from the upper surface 16 to the lower surface 18. These integral load-bearing structural supports 20 can be made of lumber (such as pine), of processed wood (such as oriented strand board), or of various shapes of structural steel. The integral load-bearing structural supports 20 are spaced throughout the bale 10 to support roof and snow loads and prevent lateral shifting.

The compressed straw 70 between the integral load-bearing structural supports 20 is held in compression by the cinctures 22 and in turn braces the integral load-bearing structural supports 20 in the plane of the wall. This creates a synergism that allows the thickness of the material used for integral load-bearing structural supports 20 to be reduced, producing both economic and environmental savings compared with conventional construction. Secondary cinctures 64 around a portion of fibrous material 70, an integral load-bearing structural support 20, and a primary cincture 22 will prevent longer bales 10 from buckling during erection and also further reinforce the integral load-bearing structural support 20.

The upper ends of the integral load-bearing structural supports 20 snap into an inverted-lip U channel 28 that serves as bond beam on the upper surface 16, where the roof will be attached. A second inverted-lip U channel 28 serves as a footing beam on the lower surface 18 to secure the lower ends of the integral load-bearing structural supports 20.

Figure 2:
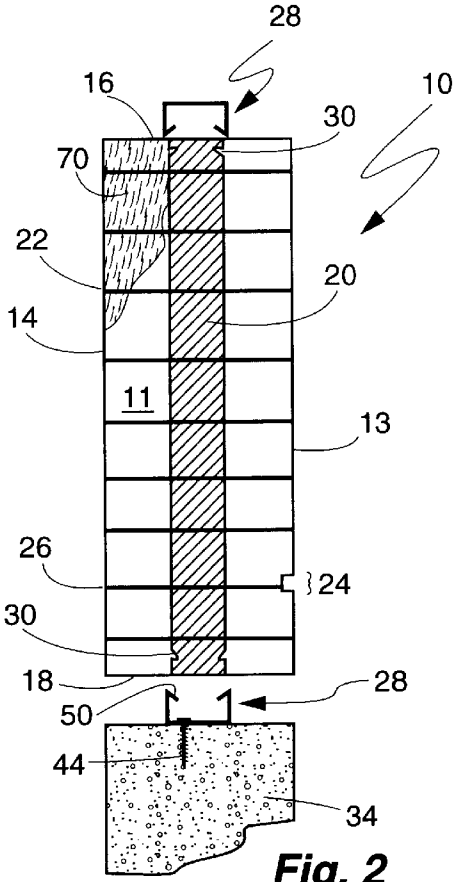
FIG. 2 shows an exploded end view of a bale having integral load-bearing structural supports.

FIG. 2 is an exploded end view of the complete footing 34 to bond beam assembly. It shows the inverted-lip U channel 28, which serves as the footing beam for the lower surface 18, fastened to the footing 34 by concrete fasteners, such as concrete nails or bolts 44. It also shows the inverted-lip U channel 28 that serves as the bond beam at the upper surface 16, for tying the top of the house together and attaching the roof. The lips of the inverted-lip U channel 28 snap into slots 30 to form an extremely strong connection. This connection is stronger than nailing and also makes assembly of the structure much faster than either conventional framing or conventional straw bale construction.

Figure 3:
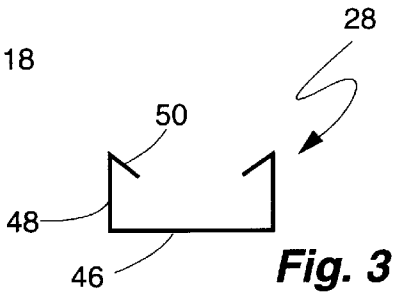
FIG. 3 shows a detail view of the inverted-lip U channel.

FIG. 3 is an end view of the inverted-lip U channel 28, which shows inverted-lip U-channel sides 48 perpendicular to the inverted-lip U-channel web 46. The inverted lips 50 at the upper edge of the inverted-lip U channel sides, are bent back toward the inverted-lip U-channel web 46.

Figure 4:
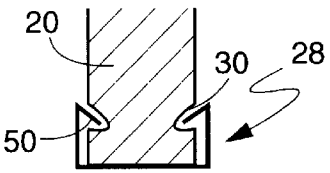
FIG. 4 shows a detail view of one embodiment of the connection between an inverted-lip U channel and an integral load-bearing structural support.

FIG. 4 is a detail view of one embodiment of the inverted-lip U channel 28 attachment to the integral load-bearing structural supports 20. Multiple slots extending over a 2- to 3-inch length can be employed to ensure that the lips of the inverted-lip U channel 28 are firmly attached to the integral load-bearing structural support 20. The distance between the inverted lips 50 is less than the width of the integral load-bearing structural support 20, so that when inserted the integral load-bearing structural support 20 spreads the lips of the inverted-lip U channel 28, this creates a tension that forces the inverted lips 50 into the slots 30, firmly maintaining the connection.

Figure 5:
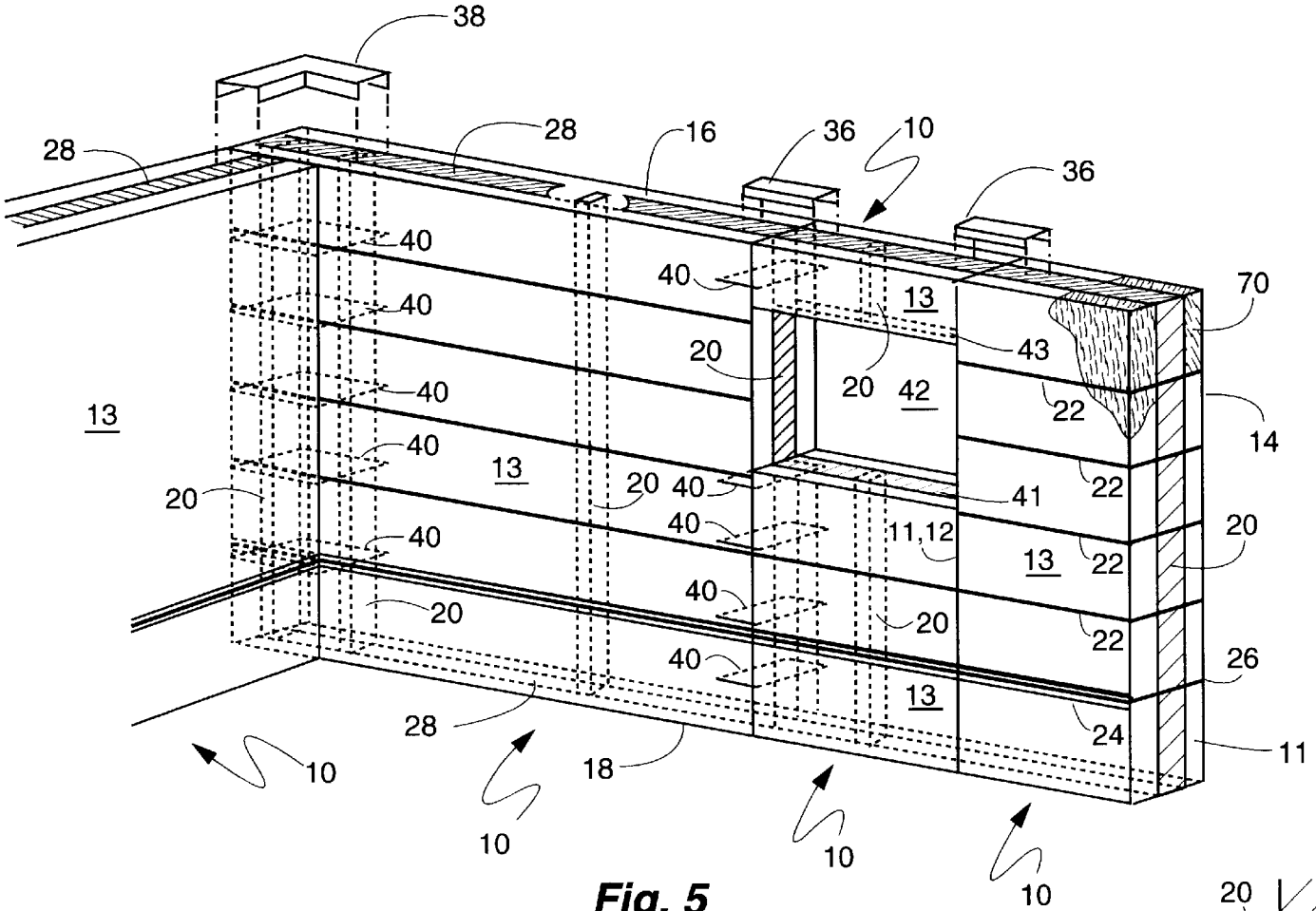
FIG. 5 shows a perspective view of wall segments composed of bales having integral load-bearing structural supports assembled to form a corner and window opening.

FIG. 5 shows the interface between two walls and a window opening 42. The bale 10 wall segments forming the corner are connected by means of banding 40, which is driven through the bale 10 behind the integral load-bearing structural supports 20 in several locations that are evenly spaced vertically. The banding 40 is then tensioned and the ends are secured together. The same method of attachment is used where the end surfaces 11 and 12 of the bales 10 are butted together, such as above and below the window openings 42. The window opening 42 is formed by bale 10 segments that are the width of the desired window opening 42. The lower segment is the height of the window sill frame, and the upper segment reaches from the window header 43 to the bond beam. Installation of windows and doors is quick and secure; the window or door frame attaches directly to the integral load-bearing structural supports 20 located in the end surfaces 11 and 12 of each bale 10 and to the inverted-lip U channels 28 that serve as window header 43 and window sill frame 41.

Lengths of U channel without inverted lips are screwed in place over abutting sections of the inverted-lip U channels 28, that serve as the bond beam, to create U-channel splices 36 which complete the bond-beam tie along the straight runs. U-channel corner splices 38 are screwed in place to complete the bond-beam tie around the house.

Figure 6:
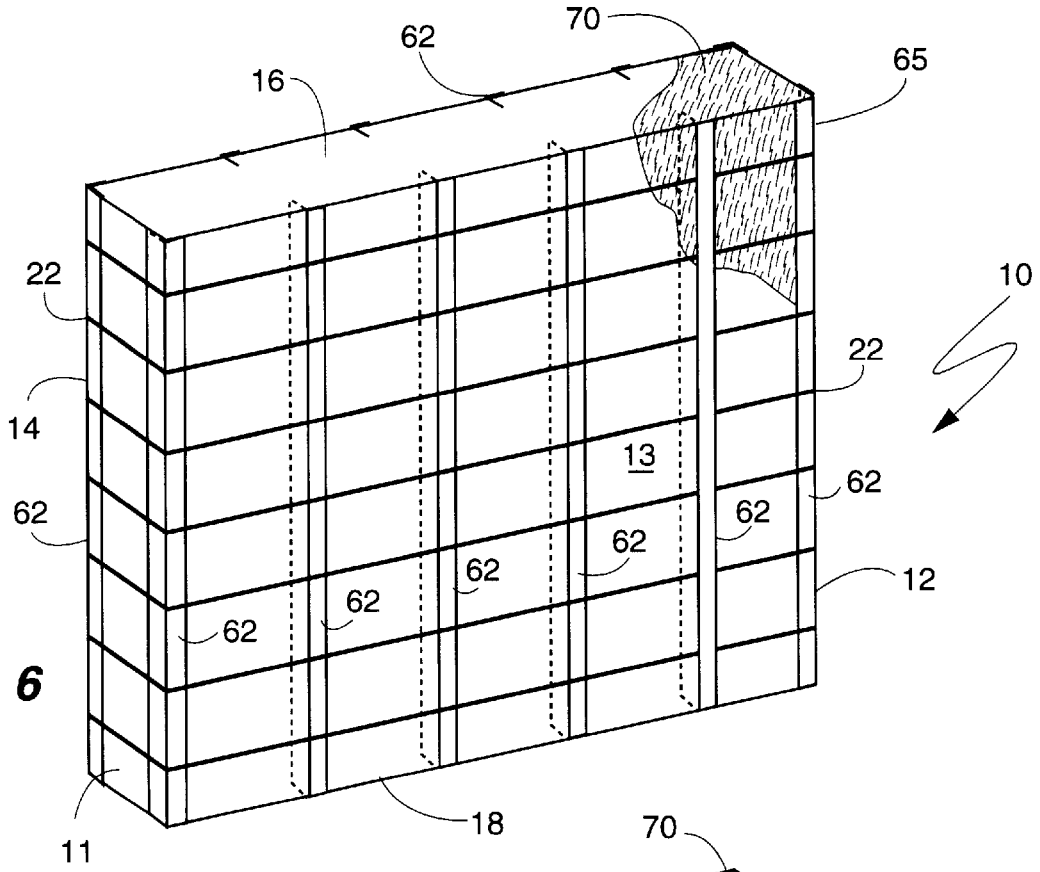
FIG. 6 shows a perspective view of a second embodiment of a bale having integral load-bearing structural supports in both side surfaces.

FIG. 6 is a perspective view of another embodiment of a bale 10 which uses angle irons for structural supports 62 on both side surfaces 13 and 14. One leg of each of these angle irons is embedded in the fibrous material as the bale is manufactured, enabling the bale 10 to be laid flat and sandwiched between roof trusses 72 to provide both insulation and a base for the roof and ceiling (see FIG. 13).

Figure 7:
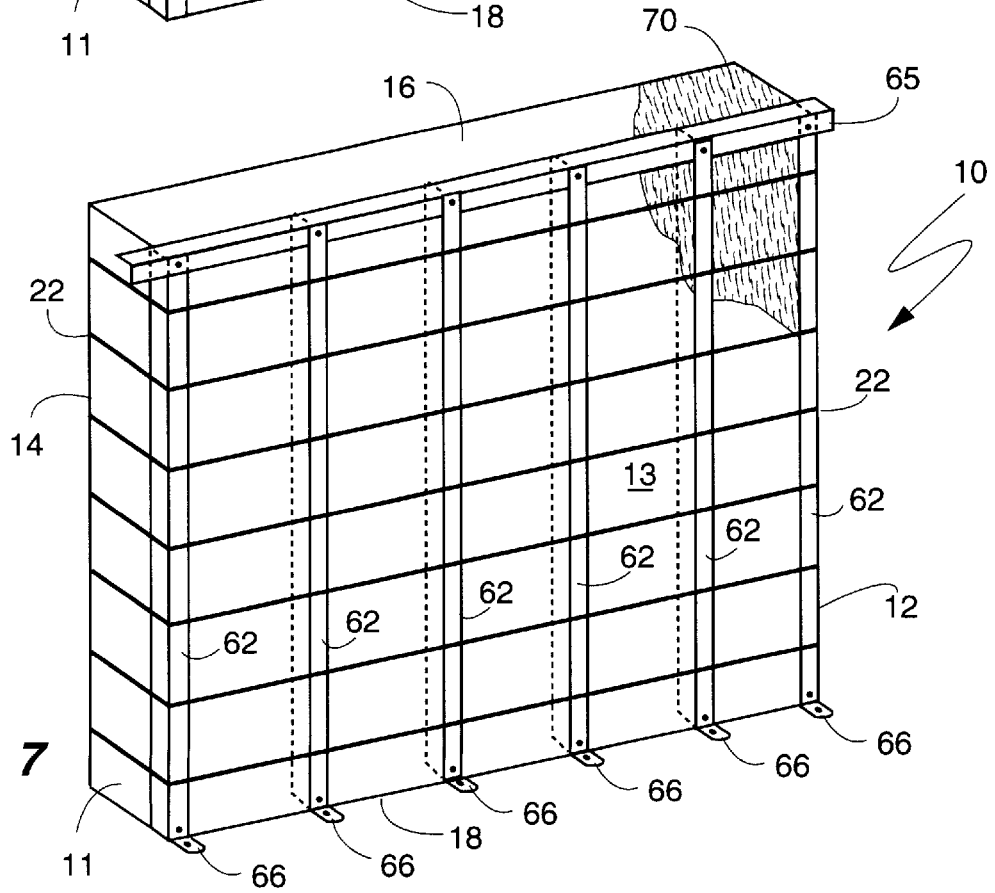
FIG. 7 shows a perspective view of third embodiment of a bale having integral load-bearing structural supports with tabs at the bottom (for connecting the integral load-bearing structural supports to the footing or floor) and an angle-iron bond beam at the top.

FIG. 7 shows a perspective view of another embodiment of a bale 10 that uses angle-iron structural supports 62, similar to the embodiment in FIG. 6 except that the structural supports extend slightly below the lower surface 18 of the bale 10. A portion of one leg of the angle iron structural support 62 (the one that is inserted into the bale 10) is cut out. The portion of the other leg that extends below the bottom surface 18 can be fastened to a footing 34, or bent out at ninety degrees (as shown) to form an attachment tab 66 for attaching the angle-iron structural support 62 directly to the floor.

Figures 8, 9, 10, 11:
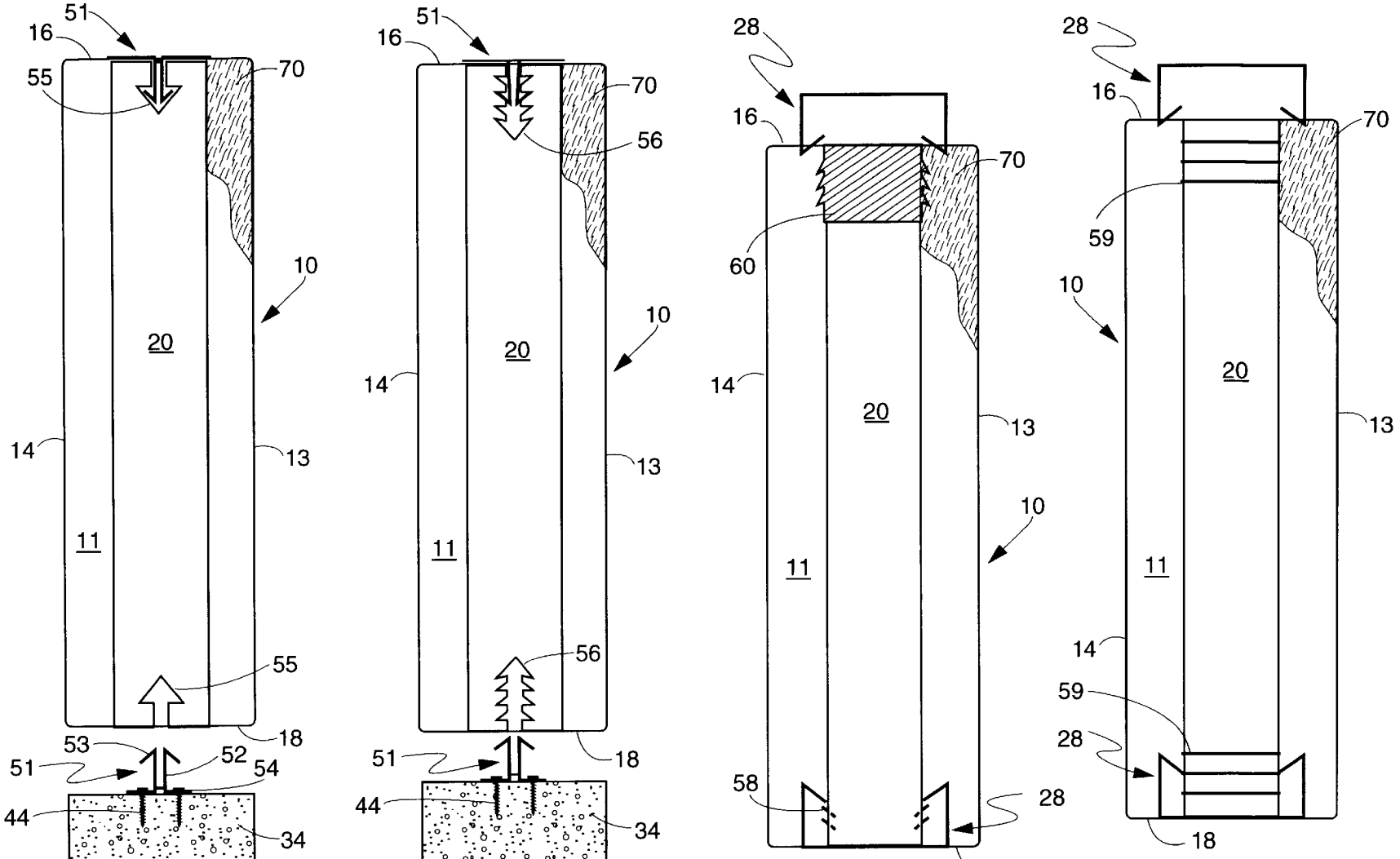
FIG. 8 shows an exploded end view of a bale in which an anchor-shaped structural connectors snap into arrow-shaped openings in the integral load-bearing structural support.
FIG. 9 shows an exploded end view of a bale with serrated slots in the ends of the integral load-bearing structural support that receives the anchor-shaped connector.
FIG. 10 shows two different embodiments of the connection between an inverted-lip U channel and a wooden integral load-bearing structural support.
FIG. 11 shows a wooden integral load-bearing structural support with multiple wire cinctures on each end and upper and lower inverted-lip U channels.

FIG. 8 is an exploded end view of a bale 10 that uses an arrow-shaped cutout 55 in the integral load-bearing structural support 20 to receive an anchor-shaped structural connector 51, forming the attachment of the bale 10 to the footing 34 or to the roof. The anchor-shaped structural connector 51 is made of two sheet-metal shapes, each with a vertical web 52, one leg 53 bent at about forty-five degrees to the web and the other leg 54 bent (toward the first leg) at ninety degrees to the web 52. The vertical webs 52 of the two pieces are fastened together to form the anchor-shaped structural connector 51. The side of the anchor-shaped structural connector 51 formed by the ninety degree legs 54 of the two sheet-metal shapes attach to the footing 34 or to the roof, and the forty-five-degree legs insert into the arrow-shaped cutout 55 at the ends of the integral load-bearing structural support 20.

FIG. 9 is an exploded end view of another embodiment of the connection at the upper surface 16 and lower surface 18 of a bale 10, in which the anchor-shaped structural connector 51 is inserted into serrated slots 56 in both ends of a integral load-bearing structural support 20.

In FIG. 10, the inverted-lip U channel 28 is snapped over the heads of staples 58 driven into the bottom end of the integral load-bearing wooden structural support 20 at a forty-five-degree angle. The upper end of the integral load-bearing structural support 20 is equipped with a metal collar 60 that has serrations over which the lips of the inverted-lip U channel 28 are snapped to make a strong, secure connection.

FIG. 11 shows another embodiment of a wooden, integral load-bearing structural support 20 with multiple cinctures of wire 59 at both ends that create ridges over which inverted-lip U channel 28 can be snapped. The cinctures, like the metal collar 60, shown in FIG. 10, have an advantage over the staples 58 (also shown in FIG. 10) in that there is no risk of splitting the wooden integral load-bearing structural support 20.

Figures 12, 13, 14:
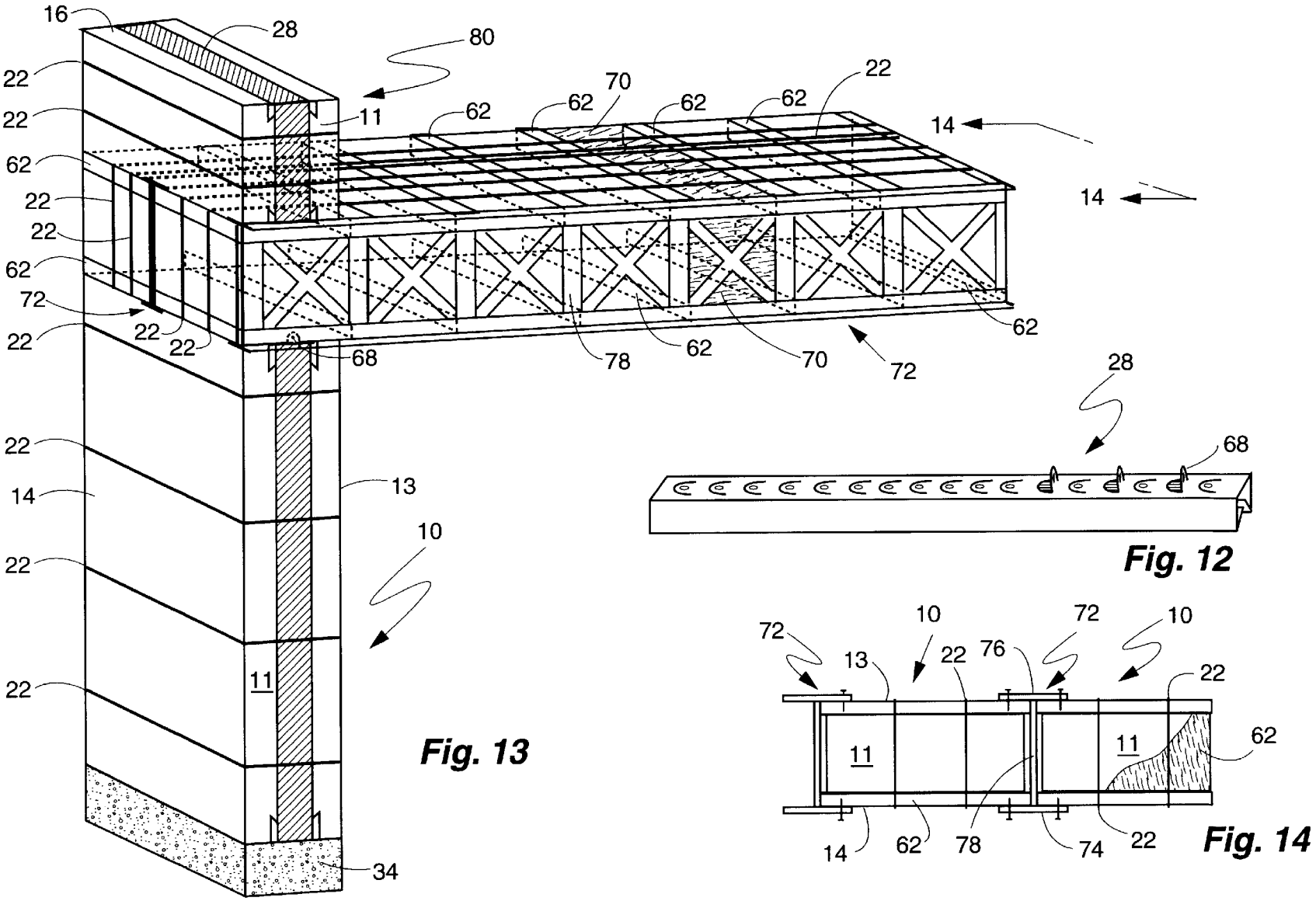
FIG. 12 shows an inverted-lip U channel with pre-punched attachment tabs.
FIG. 13 shows a perspective view of a flat-roofed building. The walls and parapet use the bales of FIG. 1; the roof utilizes the bales of FIG. 6, sandwiched between I-shaped, flat-roof trusses.
FIG. 14 is a cross-section view of the roof structure in FIG. 13.
Figure 18:
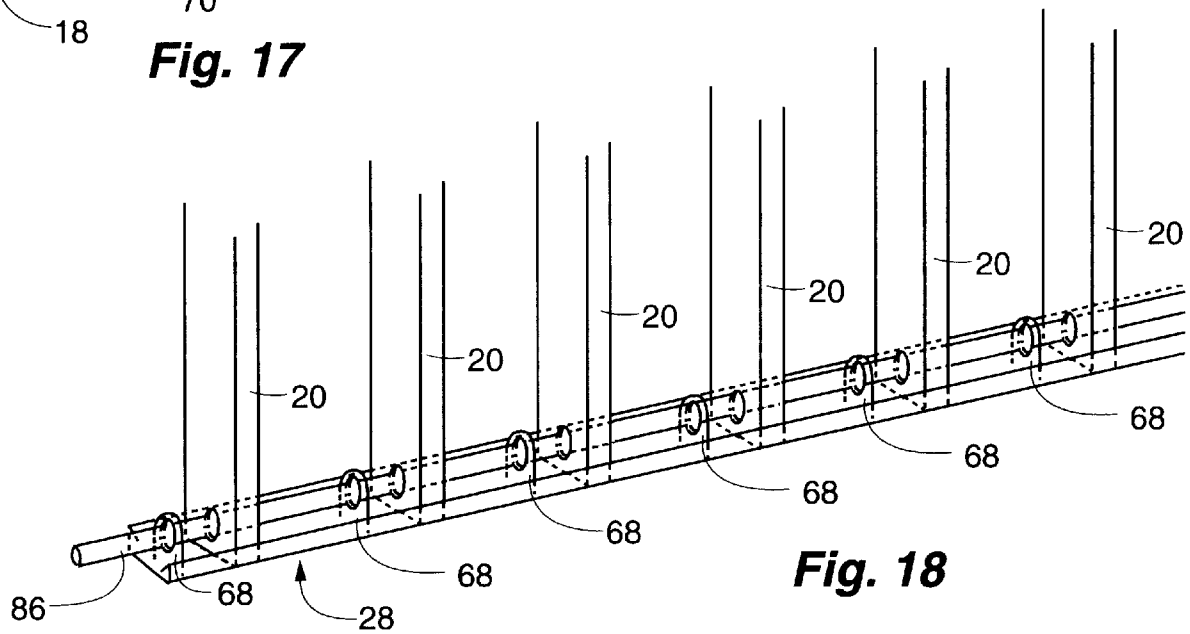
FIG. 18 shows a perspective view of a different embodiment of the connection between integral load-bearing structural supports and an inverted-lip U channel, which utilizes a metal rod or tube.

FIG. 12 shows an inverted-lip U channel 28 with attachment tabs 68 that are pre-punched and turned out to speed the attachment of trusses 72 to the inverted-lip U channel 28 that serves as the bond beam. The attachment tabs 68 that are closest to the points at which the trusses 72 are to be attached are bent up, the truss 72 is shimmed square with the building, and then screws are driven through both the attachment tabs 68 and the shims, into the truss 72. The tabs 68 could also be bent to the inside of the inverted-lip U channel to form the connection, as shown in FIG. 18

FIG. 13 is a perspective view of a building with the walls and parapet 80 constructed from bales 10 having the same configuration as shown in FIG. 1, with an inverted-lip U channel 28 for the bond beam. The roof is made from bales 10 having the same configuration as shown in FIG. 6, but are placed horizontally and sandwiched between flat roof trusses 72 that have an I-shaped profile. The trusses 72 consist of a vertical web 78, an upper flange 76, and a lower flange 74.

FIG. 14 is a cross-sectional view of the roof portion of FIG. 13 showing the angle-iron structural supports 62 in the side surfaces 13 and 14 of a bale 10, having the same configuration as in FIG. 6. The structural supports 62 are perpendicular to the trusses 72 and screwed to the upper and lower flanges 76 and 74 of the truss 72.

Figure 15:
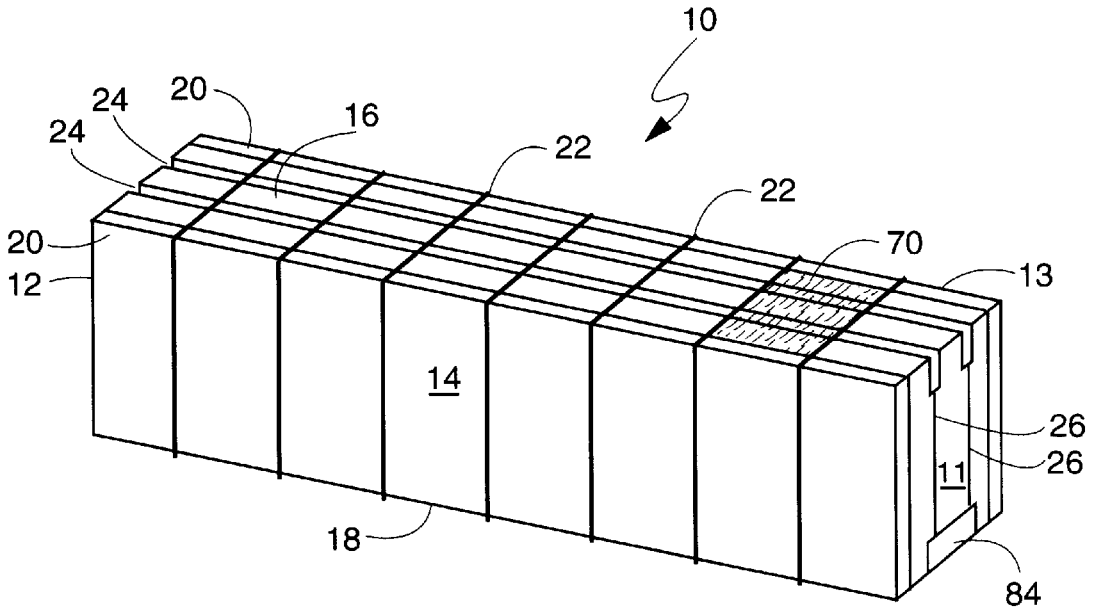
FIG. 15 shows a bale having integral load-bearing structural supports in the configuration of a post or beam.

FIG. 15 shows a perspective view of a bale 10 in the configuration of a post or beam. The main portion of compressed straw braces the integral load-bearing structural supports 20 on both side surfaces 13 and 14. There are grooves 24, for electrical conduits, on the upper side 16 and a nailer 84 of wood on the lower side 18. The use of compressed straw to provide bracing and prevent buckling makes it cheaper to fabricate esthetically appealing large beams with a minimum of wood or steel.

Figure 16:
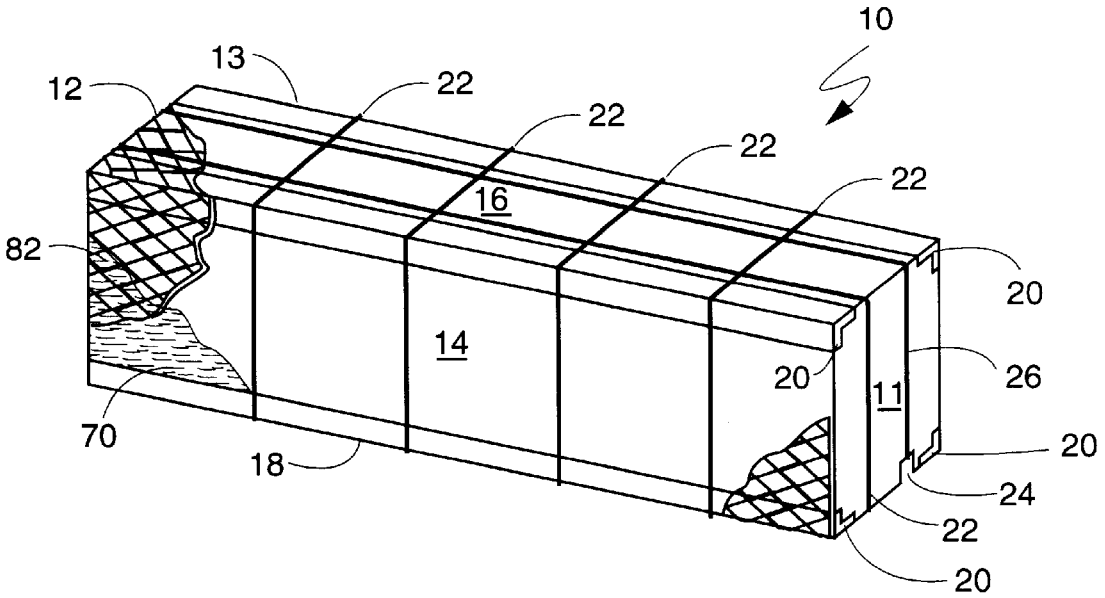
FIG. 16 shows a bale having integral load-bearing structural supports in the configuration of a post or beam with an expanded metal shell.

In FIG. 16, the bale 10 has integral load-bearing structural supports 20 along the corners formed by the intersections of side surfaces 13 and 14 with upper surface 16 and lower surface 18. The bale 10 has an expanded metal shell 82 that runs the entire length of the beam/post. This adds structural strength and facilitates the application of stucco or other finishes. The groove 24 on the lower surface 18 simplifies the routing of electrical cables.

Figure 17:
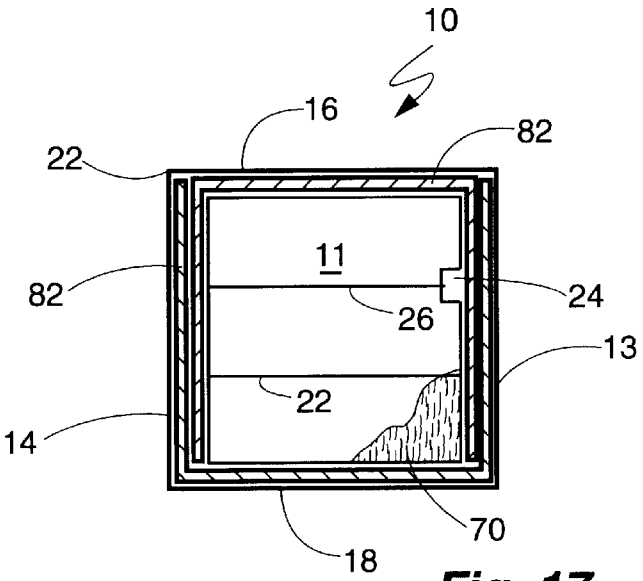
FIG. 17 shows an end view of a bale post or beam using U channels to form an expanded metal shell for additional structural support.

FIG. 17 shows an end view of a bale 10 with an expanded metal shell 82, which consists of two U-shaped channels that extend the full length of the bale 10. The bale 10 is held in compression by cinctures 22 that encircle the bale 10 lengthwise. The U-shaped channels are held in place and prevented from buckling away from the bale 10 by crosswise cinctures 22 that are evenly spaced along the length of the bale 10.

FIG. 18 is a perspective view of a integral load-bearing structural supports 20, as they would be placed in a bale 10 (as shown in FIG. 1) connected to an inverted-lip U channel 28 by a metal rod 86 that passes through holes in the integral load-bearing structural supports 20 and holes in attachment tabs 68. This very strong connection, combined with the resilience of the compressed straw 70, would allow the structure to flex in an earthquake.

OPERATION—FIGS. 1–18

Construction of a house using the bales 10 involves the following steps:

1. Determine the length of each of the various wall segments of the house. An individual wall segment may be (a) from a corner to an opening, such as that for a window or door, or (b) any manageable length of bale 10 (manageable length depends on equipment available to handle the bale 10 and the space constraints of the building site for turning and manipulating bales). Above and below each window opening 42 is also considered a wall segment.
2. Manufacture a bale 10 of the proper length for each of the wall segments of the house; install the upper inverted-lip U channel 28, which will serve as the bond beam.
3. Manufacture bales 10 for above and below each window opening 42. The height of the upper bale will be the distance from the window header 43 to the bond beam and the width will be that of the window opening 42. The height of the bottom bale will be that of the window sill frame 41 and the width will be that of the window opening 42. Install and inverted-lip U channel 28 on the lower side of the upper bale 10, above the window opening 42, to serve as the window header 43. Install another inverted-lip U channel 28 on the upper side of the lower bale 10, to serve as the window sill frame 41.
4. Fasten an inverted-lip U channel 28 to the footing 34 all the way around the structure, except at the doorways.
5. Beginning at one corner, erect the first wall segment by inserting the lower ends of the integral load-bearing structural supports 20 into the inverted-lip U channel 28, that is fastened to the footing 34. After bracing the wall segment, place a second wall segment to form the corner, and band the two segments together using bands 40 that are evenly spaced vertically. Then place the U-channel corner splice 38 over the inverted-lip U channels 28 that form the bond beams of the two wall segments and screw it in place.
6. Continue setting each bale 10 wall segment in its proper place, including the pieces for above and below window openings 42; band each bale 10 to the previous one and screw the U-channel splices 36 and 38 in place at the top. How doors are treated will depend on wall height, but the U channel will bridge the door openings to complete the bond-beam tie.
7. If a flat roof is desired (as shown in FIG. 13), manufacture bales 10 in the configuration shown in FIG. 6, the width of the truss 72. Then assemble panels, having a truss 72 attached to either the upper surface 16 or lower surface 18 of the bale 10, by screwing the ends of the structural supports 62 to the upper flange 76 and lower flange 74 of the truss 72. Set the panel in place and fastened it to the inverted-lip U-channel 28 bond beam. Set the next panel in place, fastened it to the inverted-lip U-channel 28 bond beam, then screw the unattached ends of the structural supports 62 opposite the truss 72 of that panel to the truss 72 of the previous panel. Continue this process until the roof is complete. Next, screw an inverted-lip U-channel 28 footing beam for the parapet 80 to structural supports 62 and trusses 72 around the perimeter of the roof. Then set bales 10 having the same configuration as shown in FIG. 1, of the desired height for the parapet 80, into the parapet footing beam and band them together.

8. If a post or beam is desired (as shown in FIGS. 15–17), manufacture a bale 10, with integral load-bearing structural supports 20, having the desired length, width, and height, and having grooves 24 in the appropriate locations for electrical wiring and longitudinal integral load-bearing structural supports 20. Install longitudinal integral load-bearing structural supports 20 in their grooves 24, and band in place with cinctures 22. If an expanded metal shell 82 is used, band it in place with cinctures 22.

9. If extremely strong connections are desired, use the connection shown in FIG. 18 between bales 10 and both the bond beam and footing beam. This connection would be slower to construct but even stronger than the embodiments shown in FIGS. 2 and 8–11, which snap together. To assemble this embodiment, hold the bale 10 wall segment above the inverted-lip U channel 28 footing beam while a cable is threaded alternately through the attachment tabs 68 of the inverted-lip U channel 28 and pre-punched holes in the integral load-bearing structural supports 20. The inverted-lips 50 of the inverted-lip U channel 28 align the holes in the attachment tabs 68 and those in integral load-bearing structural supports 20 as the wall segment is lowered into place and the slack in the cable was taken up. Attach one end of the cable to a metal rod 86 and draw it through the holes to complete the connection. Assemble the connection at the upper surface 16 in the same manner without suspending the bale 10. Where space constraints prevent the use of the inflexible metal rod 86, a stiff cable of the same diameter as the metal rod 86 can be substituted.

RAMIFICATIONS AND SCOPE

One can readily see that this bale construction system is a very rapid way to construct energy-efficient housing with lower embodied energy and less on-site labor than conventional means of construction. The inherent flexibility of this construction system provides a way to use a variety of structural materials in combinations that best exploit the unique physical properties of each.

Although the description above contains many specificities, these should not be construed as limiting the scope of the invention but as merely providing illustrations of some of the presently preferred embodiments of this invention. For example, in another embodiment of the present invention, U channels without inverted lips would receive the integral load-bearing structural supports of bales (in the configuration shown in FIG. 1), and cinctures would run vertically under the footing beam and over the bond beam to tie the roof to the footing. The grooves can be shaped differently and placed differently, the integral load-bearing structural supports can be made from different shapes and materials and placed differently in the bale, and various methods can be used to connect the bales together, including wire or rope. Even adhesive can be used as long as appropriate integral load-bearing structural supports are present at the locations to be glued. Bales of the configuration shown in FIG. 6, can be used with I-shaped beam oriented vertically for several purposes, including the walls for multi-story buildings.

Thus, the scope of the invention should be determined by the appended claims and their legal equivalents, rather than by the examples given.

I claim:

1. A bale comprising compressed fibrous material and a plurality of cincture means that hold the fibrous material in compression, having a pair of opposed end surfaces, a pair of opposed side surfaces, and a pair of opposed upper and lower surfaces traverse of said side surfaces, having load-bearing structural support means of pre-determined cross-sections placed in predetermined locations and in predetermined orientations with main portions of said load-bearing structural support means integral to and within said bale, and further comprising a first structural connector means which serves as a bond beam at said upper surface and a second structural connector means serving as a footing beam at said lower surface whereby said compressed fibrous material with said plurality of cincture means and said integral load-bearing structural support means create a synergystic package that permits the use of thinner said integral load-bearing structural supports and taller, thinner said bales, reducing consumption of lumber, steel, and straw.

2. The device as set forth in claim 1 wherein said structural connector means comprise U channels comprising a web portion of predetermined width which is at approximately right angles to sides of predetermined height and each said side having extensions of predetermined length, said extensions being bent inwardly and back toward said web at a predetermined angle whereby said integral load-bearing structural support means are securely gripped when inserted between said extensions to form a quick, strong and effective connection between footing, integral load-bearing structural support means, and roof.

* * * * *